United States Patent [19]

Bresnyan

[11] 4,185,338

[45] Jan. 29, 1980

[54] TOILET FLUSHING APPARATUS

[76] Inventor: Nicholas P. Bresnyan, 214 Candlewood Rd., Groton, Conn. 06340

[21] Appl. No.: 907,094

[22] Filed: May 18, 1978

[51] Int. Cl.[2] ..... E03D 1/14; E03D 5/09

[52] U.S. Cl. ..... 4/327; 4/381; 4/394

[58] Field of Search ..... 4/324–327, 4/378, 379, 415, 381, 384, 394–397, 345, 398, DIG. 1

[56] References Cited

U.S. PATENT DOCUMENTS

| | | | |
|---|---|---|---|
| 2,760,206 | 8/1956 | Loyd | 4/327 |
| 3,259,918 | 7/1966 | Walker, Sr. et al. | 4/415 |
| 3,731,324 | 5/1973 | Moon | 4/415 |
| 3,839,747 | 10/1974 | Clark | 4/327 |
| 3,916,455 | 11/1975 | Longdin | 4/327 |
| 3,939,507 | 2/1976 | Clark | 4/327 |
| 4,025,968 | 5/1977 | Davis | 4/325 |
| 4,115,882 | 9/1978 | Paulus | 4/327 |

*Primary Examiner*—Stuart S. Levy
*Attorney, Agent, or Firm*—Albert W. Hilburger

[57] ABSTRACT

A double valve construction selectively provides a full flush or a partial flush from the tank of a toilet. The apparatus, which may be utilized to modify existing toilet water closets, includes a hollow cylinder with a first valve on its lower end engageable with a first valve seat on an upper end of an outlet from the tank. The upper end of the cylinder defines a second valve seat and a second valve is engageable with the second valve seat. As an operating handle is selectively moved through a first range of travel, it disengages the second valve from the second valve seat for a partial flush and as the operating handle is moved through a second range of travel, it disengages the first valve from the first valve seat for a full flush. The volume of water utilized in a full flush is adjustable, and a mechanism is provided for holding the first valve in its open position until a full flush has been achieved.

8 Claims, 10 Drawing Figures

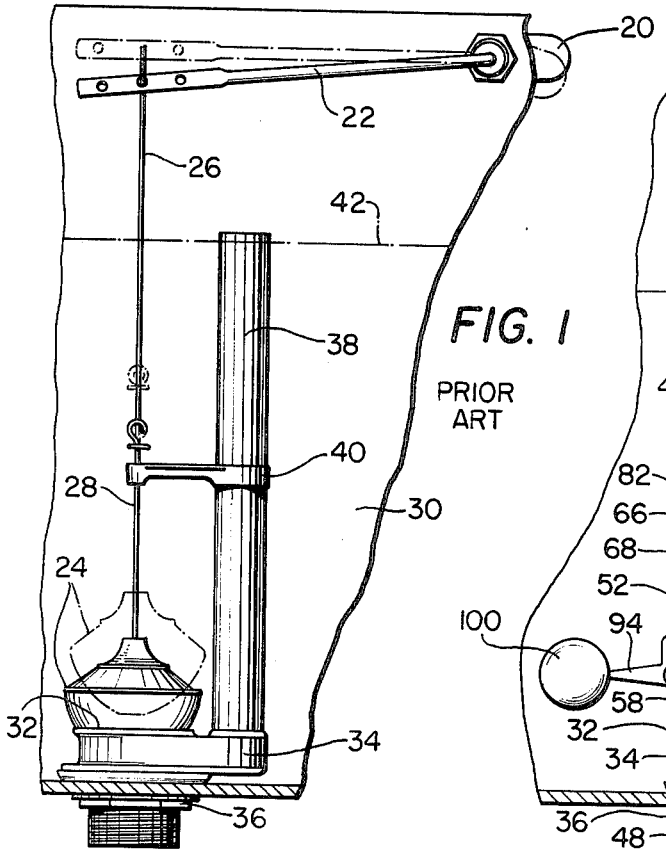
FIG. 1
PRIOR ART
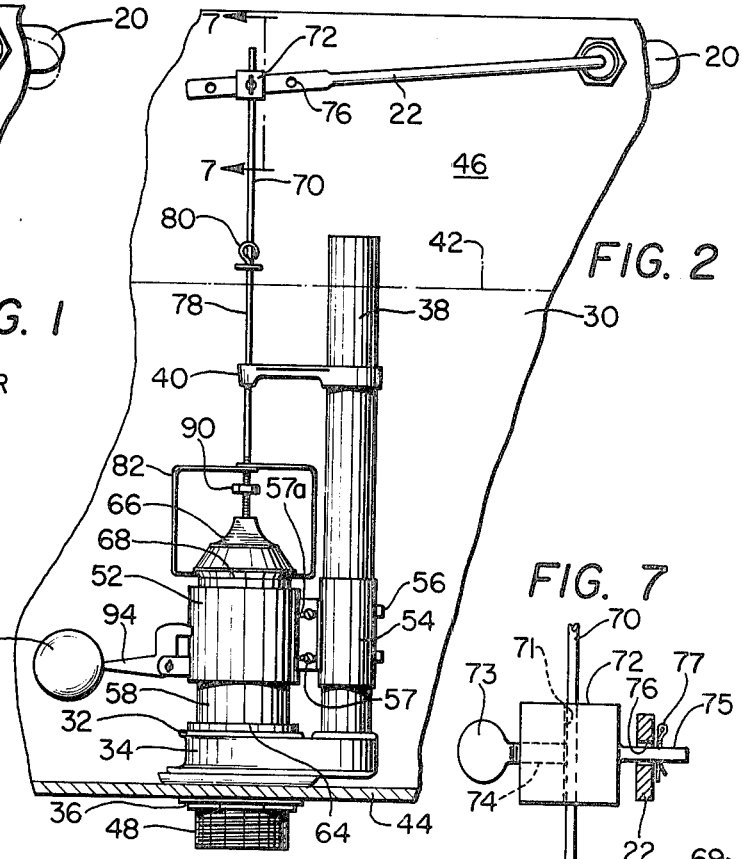
FIG. 2
FIG. 7
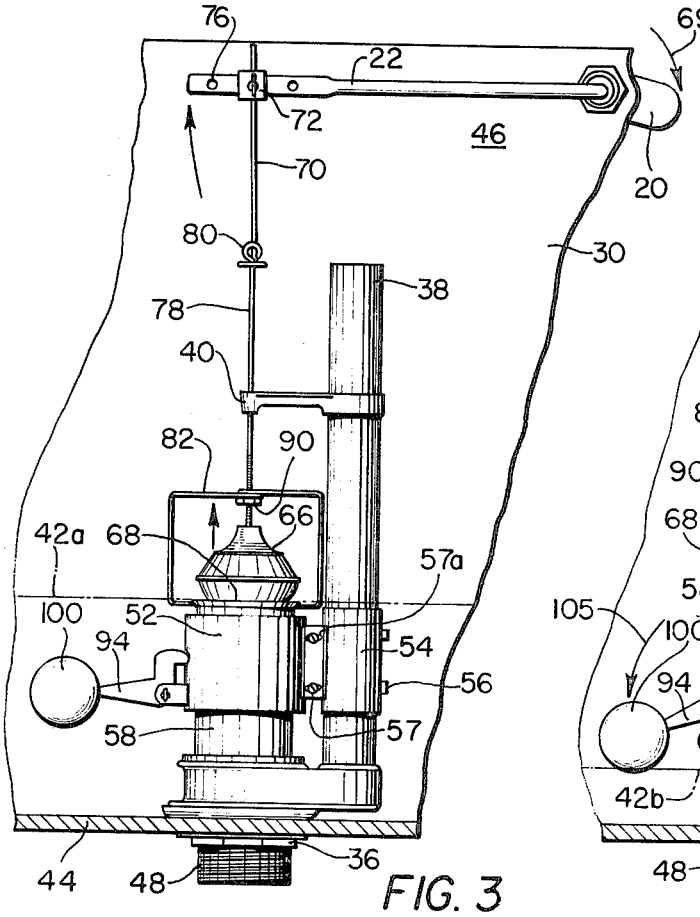
FIG. 3
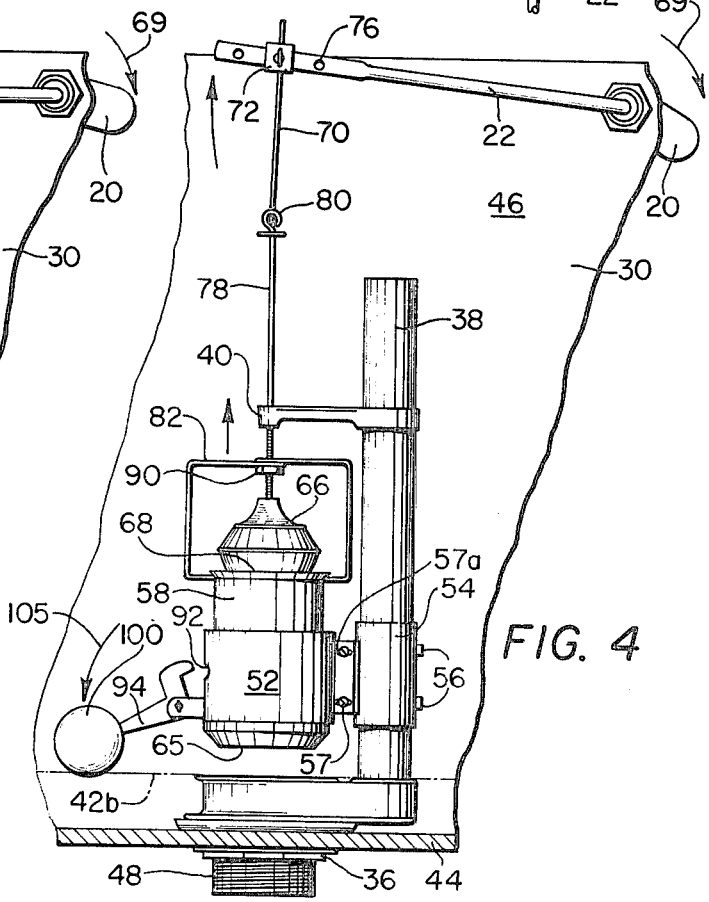
FIG. 4

TOILET FLUSHING APPARATUS

BACKGROUND OF THE INVENTION

1. Field of Invention

This invention relates generally to improvements in toilet flush apparatus and, more particularly, to those improvements which enable, selectively, either a full flush or a partial flush of the water in the flush tank.

2. Description of the Prior Art

In recent years, it has become more and more apparent that our natural resources are not as plentiful as they were once believed to be. It came to be realized that even water, one of our most plentiful of natural resources, was becoming threatened. As a result, efforts began to conserve more natural resources, including water. It also came to be realized that one device, in particular, utilized daily by individuals, namely a toilet, consumes very large amounts of water in its operation. Although a full capacity of the flush tank for a toilet may be necessary in order to dispose of solid wastes, a much smaller quantity of flush water is effective to dispose of liquid wastes. Hence, if a toilet performs a full flush even when disposing of liquid wastes, the consumption of water in the disposal process is unnecessary and excessive. When such usage by an individual is multiplied by the size of the population, it can be appreciated that the quantity of water used needlessly in a day's time is very great indeed. The excessive use of water involves, in many instances, increased costs to the consumer for electricity, water and sewer services and also puts an unnecessary burden on all sewage disposal systems.

When concerned people first came to realize this situation, it was not unusual for them to place bricks, rocks, or other water displacing articles in the flush tank to thereby reduce the volume of water available for a flush. It also came to be known to place weirs or dams in the flush tank surrounding the outlet valve, similarly for the purpose of reducing the volume of water in the tank available for flushing. Such constructions are disclosed in U.S. Pat. Nos. 3,259,918 and 3,731,324, which recite the common problems of securing and sealing the weirs or dams within the flush tank.

Another proposed solution is disclosed in U.S. Pat. No. 3,939,507 in which a cylindrical tube is placed atop the outlet to raise the minimum water level in the tank and thereby reduce the volume of water discharged during flushing. The cylindrical tube is intended to be a permanent arrangement similar to the weirs or dams previously discussed.

Also known to the applicant are the U.S. Pat. Nos. 2,760,206 and 3,916,455 each of which discloses a double valve construction, one atop the other, for selectively providing either a full flush or a partial flush, as desired.

In many instances, the prior art has disclosed complex constructions which are expensive to manufacture and maintain and which are not readily applicable to existing flush tanks. In many instances, they did not provide adjustments for selectively enabling a full flush or a partial flush. For example, in the earlier groups of patents or prior art described above, the expedients often only permitted a partial flush even when a full flush may have been desirable or necessary, as with solid wastes. Then, with respect to Patent No. 3,916,455 mentioned above, no mechanism was provided to automatically hold open the full flush valve until such time that a full flush was actually achieved. Rather, the operator was usually required to hold the operating handle in an extreme position until the full flush was obtained, else the full flush valve would close before the flush tank was completely emptied. Further, with respect to Patent No. 2,760,206, the flow rate permitted by the upper valve was significally less than that permitted by the lower valve, the result being a weak partial flush as compared with the full flush.

SUMMARY OF THE INVENTION

It was with recognition of these problems and the state of the prior art that the present invention was conceived. Thus, the present invention discloses a double valve construction which selectively provides either a full flush or a partial flush from the flush tank of a toilet, as desired. The apparatus, which may be utilized to modify existing toilet water closets, includes a hollow cylinder with a first valve fixed on its lower end and engageable with a first valve seat on an upper end of an outlet from the flush tank. The upper end of the cylinder defines a second valve seat and a second valve is engageable with the second valve seat. As an operating handle attached to the structure of the tank is selectively moved through a first range of travel, it causes the second valve to be disengaged from the second valve seat thereby allowing for a partial flush from the flush tank. As the operating handle continues to be moved through a second range of travel, it causes the first valve to be disengaged from the first valve seat with a resultant full flush from the flush tank. The volume of water utilized in a full flush can be adjusted, and a mechanism is desirably provided for holding the first valve in its open position until the full flush has been achieved.

As compared with many of the patents known to the prior art, the present invention is of simplified construction and utilizes a minimum number of parts in its construction. Furthermore, the invention utilizes existing materials and components. A major benefit of the invention is that it can be applied to existing flush tanks by an individual who has no particular expertise in the field of plumbing.

An additional benefit of the invention resides in its adjustability by reason of which the volume of water consumed for a full flush can be adjusted according to the specific requirements of the user's system.

Other features of the present invention reside in its construction whereby positive connections are provided between the valves and the operating handle during the opening sequence of operation. Also, a mechanism is provided for automatically delaying the reseating of the full flush valve until a full flush has actually been achieved.

Other and further features, objects, advantages, and benefits of the invention will become apparent from the following description taken in conjunction with the following drawings. it is to be understood that both the foregoing general description and the following detailed description are exemplary and explanatory but are not restrictive of the invention. The accompanying drawings, which are incorporated in and constitute a part of this invention, illustrate one embodiment of the invention, and together with the description, serve to explain the principles of the invention.

BRIEF DESCRIPTION OF THE DRAWINGS

In the drawings:

FIG. 1 is a detail side elevation view illustrating a portion of a flush tank known to the prior art, certain parts being cut away and shown in section and certain parts being shown in phantom in order to show a different position of those same parts illustrated by solid lines;

FIG. 2 is a detail side elevation view illustrating the interior of a flush tank incorporating the principles of the present invention, with all parts assuming a relaxed or normal position, certain parts being cut away and shown in section;

FIG. 3 is a detail side elevation view similar to FIG. 2 but illustrating an intermediate position of certain parts;

FIG. 4 is a detail side elevation view, also similar to FIG. 2 illustrating an extreme position of certain parts;

FIG. 7 is a detail cross-section view taken generally along line 7—7 in FIG. 2;

DESCRIPTION OF THE PREFERRED EMBODIMENTS

Figure 5:
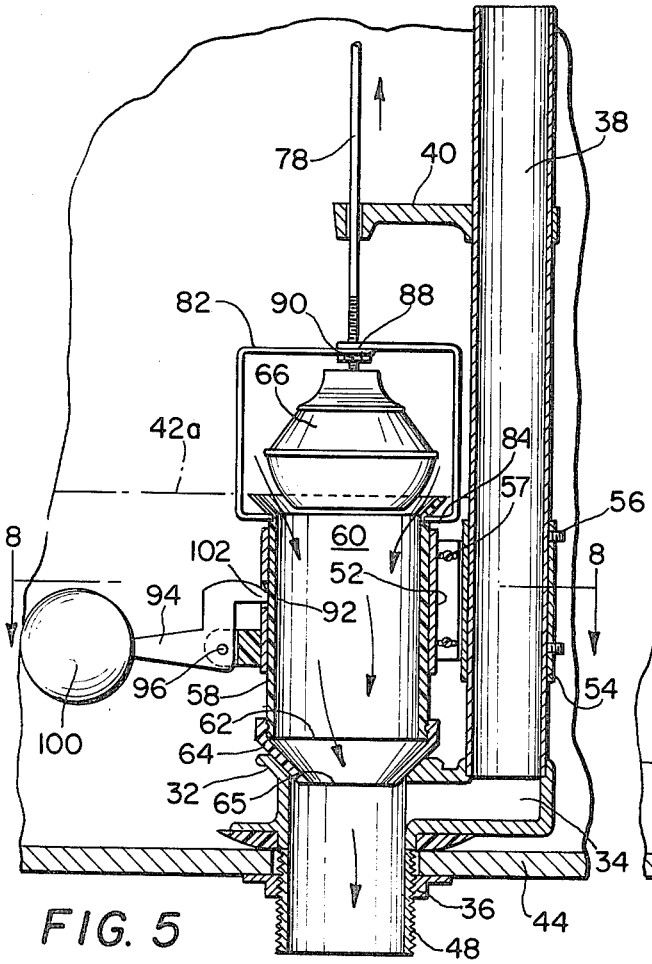
FIG. 5 is an enlarged side elevation view of parts illustrated in FIG. 3, certain parts being cut away and in section.

Refer now to the drawings and initially to FIG. 1 which is generally illustrative of the prior art. Thus, according to the known construction, when a toilet is flushed, a flush handle 20 is moved manually from the solid line position to the dotted line position and similarly rotates a trip lever 22 thereby raising a tank valve 24 via lift wires 26 and 28 similarly from a solid line position to a dotted line position.

The solid line position of the tank valve 24 represents a closed position preventing escape of water from a flush tank 30 as the tank valve 24 rests on a seat 32 of hollow support member 34. The support member 34 is suitably mounted to the bottom of the flush tank 30 by means of a lock nut 36. A standpipe or overflow tube 38 is threadedly mounted at its lower end to the support member 34 and is in communication with the support member to prevent water within the flush tank 30 from overflowing the top of the tank. A bracket 40 is suitably mounted on the overflow tube 38 and is suitably apertured distant from the tube to appropriately guide the lift wire 28 as it is moved between its lowered and raised positions. The tank valve 24 is suitably provided with some measure of buoyancy so that, once lifted from the valve seat 32, it remains disengaged from the valve seat until the water in the flush tank 30 has been lowered from a full condition as represented by a center line42 to a level approximately in the plane of the valve seat 32. When the tank 30 is then nearly empty, the tank valve 24 falls back into place in engagement with the valve seat 32 and prevents any further flow of water from the tank 30 via the support member 34.

The invention is an improvement over the construction illustrated in FIG. 1. In accordance with the invention, apparatus for flushing a toilet comprises: a tank capable of being filled with water including a bottom and sidewalls, and having an outlet at its bottom for draining water therefrom; a hollow support member mounted on the tank including a first valve seat adjacent the bottom of said tank and communicating with the outlet; and a hollow standpipe mounted on said support member and extending upwardly therefrom, the interior of said standpipe being in communication through said support member with the outlet.

As embodied herein, and with particular reference initially to FIG. 2, the tank 30 of the invention may be similar in all respects, if desired, to the tank already described with respect to FIG. 1. As such, it includes a bottom 44 and a plurality of sidewalls 46 to support a quantity of water, the upper level of which is similarly represented by the center line 42. The hollow support member 34 may also be similar in all respects, if desired, to the support member 34 already described with respect to FIG. 1, and includes an integral fitting 48 which extends through a suitable opening in the bottom 44 of the tank 30. Together with the lock nut 36, the fitting serves to fix the support member 34 to the bottom 44. The fitting 48 also defines an outlet at the bottom of the tank which enables water to be drained from the tank. As previously described, the member 34 is formed with a first valve seat 32 adjacent the bottom of the tank 30 and since the support member 34 is hollow, the valve seat 32 communicates with the outlet defined by the fitting 48. At a location proximate to the valve seat 32, the overflow tube 38 may be threadedly mounted to the support member 34 or may be mounted in any other suitable fashion. Being hollow, the interior of the overflow tube 38 is in communication with the interior of the support member 34 and thereby with the outlet defined by the fitting 48. During normal operation, the overflow tube 38 serves to prevent the level of the water within the tank 30 from reaching a level higher than its uppermost end. Specifically, should the level of the water tend to rise above the upper end of the overflow tube 38, the water would flow into the tube and out through the fitting 48. As a practical matter, then, the upper end of the overflow tube 38 defines the upper limit of the water level within the tank 30.

In accordance with the invention, the apparatus for flushing a toilet also comprises a tubular sleeve mounted to said standpipe and spaced therefrom; a cylinder having upper and lower ends slideably received within said sleeve and including a first valve fixed to its lower end movable between a closed position engageable with said first valve seat to prevent the flow of water out of said tank through the outlet and an open position spaced from said first valve seat to permit the flow of water out of said tank through the outlet, said upper end defining a second valve seat; a second valve movable between a closed position engageable with said second valve seat to prevent the flow of water out of said tank through said cylinder and an open position spaced from said second valve seat to permit the flow of water out of said tank through said cylinder and then through the outlet. As embodied herein, with particular reference to FIGS. 2, 3, and 4, a tubular sleeve 52 is mounted to the overflow tube 38 by means of an adjustable bracket 54 which may itself be in the form of a sleeve received on the overflow tube 38. The height of the bracket 54 and of the sleeve 52 may be adjusted relative to the bottom 44 of the tank 30. When a desired position of the bracket 54 is achieved on the overflow tube 38, one or more suitable fasteners 56 may be tightened to hold the bracket 54 and the sleeve 52 in that desired position. Also, lateral positioning of the sleeve 52 can be achieved by means of suitable fasteners 57 and associated elongated slots 57*a* formed in the sleeve 52.

Figure 6:
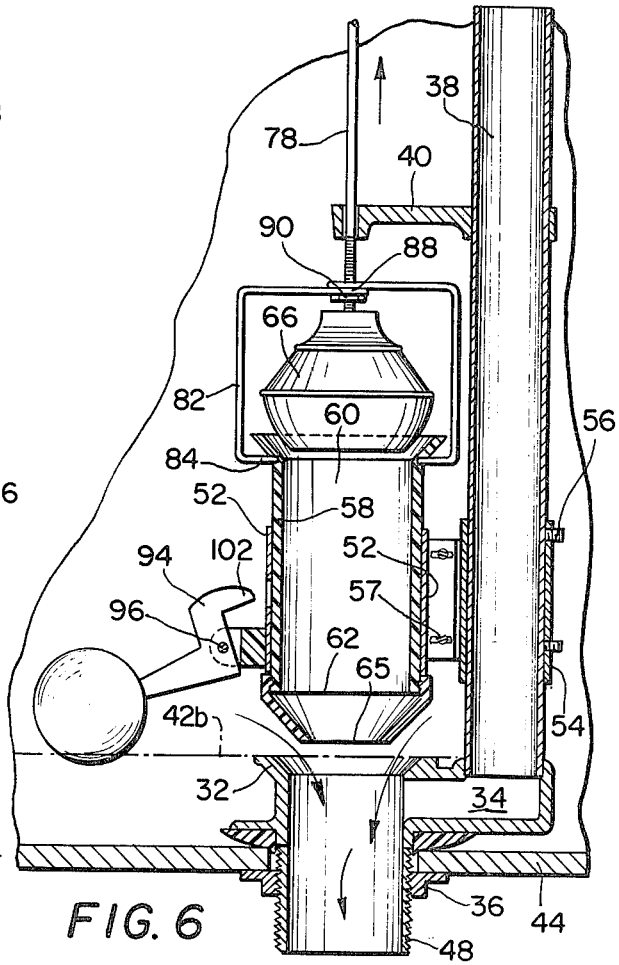
FIG. 6 is an enlarged side elevation view similar to FIG. 5, of parts illustrated in FIG. 4, certain parts being cut away and in section.
Figure 8:
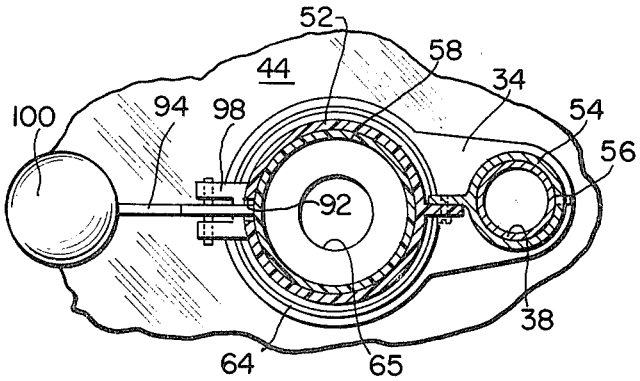
FIG. 8 is a cross-section view taken generally along line 8—8 in FIG. 5.

Turning now to FIGS. 5 and 6, a cylinder 58 can be viewed having an upper end 60 and a lower end 62 and being slideably received within the sleeve 52. A first valve 64 composed of soft rubber or other suitable resilient material may be fittingly received on the lower end 62 of the cylinder 58 such that when it assumes a closed position as illustrated in FIGS. 2, 3, and 5, the valve 64 is engageable with the first valve seat 32 thereby preventing the flow of water out of the outlet defined by the fitting 48. The valve 64 has an opening 65 formed in its base having limits located radially inwardly from the valve seat when disposed in the closed position. When the cylinder 58 and the first valve 64 are raised to the open position as illustrated in FIGS. 4 and 6, the valve 64 assumes an open position spaced from the valve seat 32 thereby permitting the flow of water out of the tank 30 through the outlet defined by the fitting 48.

A second valve 66 is positioned adjacent to the upper end 60 of the cylinder 58. This valve may be of a conventional construction such as the valve 24 (see FIG. 1), being composed of rubber or other suitable resilient material and having some measure of buoyancy. An upper rim 68 at the upper end 60 of the cylinder 58 is preferably flared to define a second valve seat and generally conforms with the outer contour of the second valve 66. In this manner when the second valve 66 is in engagement with the valve seat 68, flow of water from the tank 30 through the upper end 60 of the cylinder 58 is prevented. Conversely, when the second valve 66 assumes an open position spaced from the second valve seat 68, the flow of water out of the tank 30 and through a cylinder 58 for discharge through the outlet defined by the fitting 48 is permitted.

In accordance with the invention, apparatus for flushing a toilet additionally comprises a handle pivotally mounted on a sidewall of said tank; a lever arm fixed at one end to said handle; a first lift wire pivotally mounted at one end to said lever arm at a location distant from said handle; a second lift wire fixed at one end to said second valve, said first and second lift wires being connected together and adapted for universal movement at locations intermediate said lever arm and said second valve, said first and second lift wires being relatively movable longitudinally; a guide bracket fixed to said standpipe and effective to guide said second lift wire as it moves said second valve means between said open and closed positions; a bail member fixed to said cylinder and slideably received on said lift wire whereby rotation of said handle through a first range of travel causes said second lift wire to lift said second valve to be disengaged from said second valve seat and resulting in a flow of water from said tank equivalent to a partial flush; adjustable stop means on said lift wire engageable with said bail whereby continued rotation of said handle through a second successive range of travel causes said bail to engage said stop means and lift said first valve to enable the flow of water out of said tank through the outlet resulting in a flow of water from said tank equivalent to a full flush.

As embodied herein, and with continuing reference to FIGS. 2, 3, and 4, the flush handle 20 is pivotally mounted on a sidewall 46 of the tank 30. When the handle is moved in the direction of an arrow 69 (FIG. 3) from the position illustrated in FIG. 2 through an intermediate position illustrated in FIG. 3 to an extreme position illustrated in FIG. 4, it similarly rotates a trip lever 22 fixed to it at one end through the various positions illustrated. A first or upper lift wire 70 is suitably mounted at its upper end to an end of the lever 22 distant from the handle 20. One example of the mounting of the lift wire 70 to the lever 22 is illustrated with particular clarity in FIG. 7. In this construction, the lift wire 70 is slideably received through a bore 71 of a mounting block 72 and a thumb screw 73 is received in a suitably tapped hole 74 which communicates with the bore 71. The thumb screw 73 is thus able to engage the lift wire 70 and hold it against further movement relative to the mounting block 72. A pin 75 integral with the block 72 and extending outwardly from its outer surface can be received in an appropriate one of a possible series of holes 76 formed inwardly from the end of the lever 22. A cotter pin 77 serves to effectively retain the block 72 on the lever 22. By loosening, then tightening, the thumb screw 73, the block 72 can be positioned and repositioned so as to assure an appropriate length of the lift wire 70.

A second or lower lift wire 78 may be connected at its upper end to the upper lift wire 70 in any suitable manner, a conventional construction being indicated by the reference numeral 80. Such a construction affords universal movement between the lift wires 70 and 78 and also permits them to move longitudinally relative to one another. The term "universal movement" is intended to mean that the lift wires 70 and 78 are able to freely move from a position of mutual alignment into a variety of positions of mutual disalignment while yet remaining loosely engaged. The lower lift wire 78 is slideably received within an extension of the bracket 40, and while it is held against lateral movement relative to the bracket, it is longitudinally slideable relative to the bracket. The lower end of the lower lift wire may be threadedly engaged with the second valve 66 such that operation of the handle 20 and the trip lever 22 can effectively raise the valve 66 through the lift wires 70 and 78. Connection 80 serves to prevent binding from occurring between the lift wire 78 and the bracket 40 as the lever 22 passes through an arc which carries the particular mounting hole 72 out of a linear relationship with the lift wire 78 and the valve 66. The connection 80 also allows the valve 66 to float independently of the lift wire 70 and lever 22.

Figure 9:
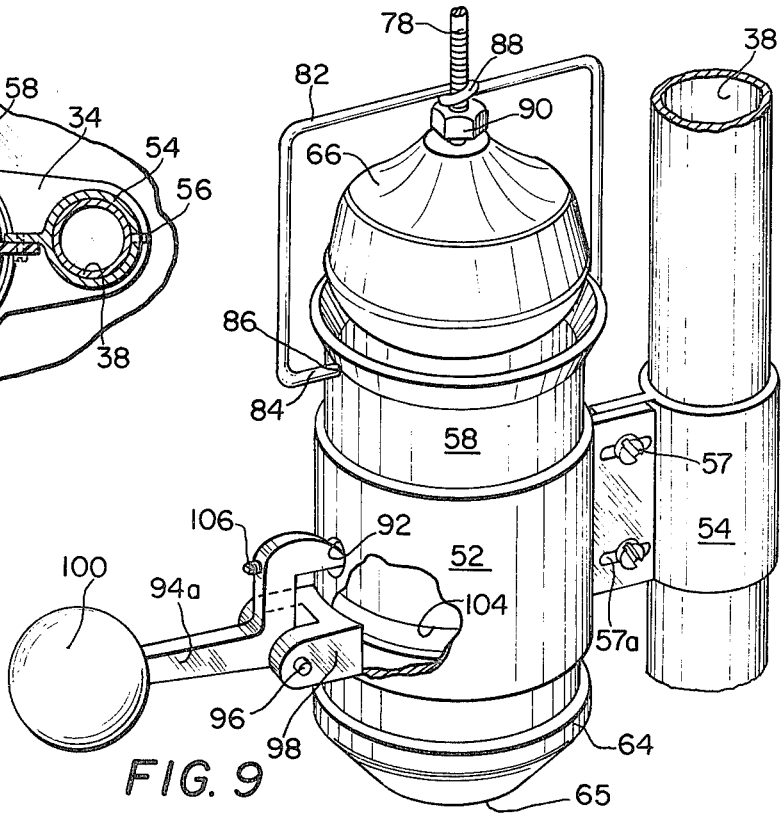
FIG. 9 is a perspective view generally illustrating a modified embodiment of the invention.

As particularly well seen in FIGS. 5, 6, and 9, a bail member 82 preferably fashioned from wire, possibly having a guage similar to the lift wires 70 and 78, is so formed that its free ends 84 (FIG. 9) are received in notches 86 formed in the outer surface of the cylinder 58 at diametrically opposite locations. It will be appreciated that the notches 86 do not extend through the material forming the cylinder 58 so as to insure the water tight integrity of the cylinder as a valve component. It is preferred, for purposes of the invention, that the resiliency within the wire forming the bail 82 assures the retention of the ends 84 within the notches 86. Located centrally of the bight portion of the bail member 82 is a loop 88 which loosely receives the lower lift wire 78. Thus, within certain limits, the lift wire 78 may be raised and lowered relative to the bracket 40 without affecting movement of the cylinder 58.

A nut 90, serving as an adjustable stop member, is threadedly received at the lower end of the lift wire 78. As the lift wire 78 is raised upon rotation of the handle 20 through the first range of travel, the second valve 66 is disengaged from the second valve seat 68 so as to permit a flow of water from the tank through the outlet defined by the fitting 48 and this is equivalent to a partial flush of the toilet. Specifically, with the second valve 66 raised to the positions illustrated in FIGS. 3 and 5, the water in the tank 30 can be reduced from the level indicated by the center line 42 to a level indicated by a center line 42*a* and defined by the valve seat 68 of the second valve 66.

As the handle 20 continues its rotation in the direction of the arrow (FIG. 4), the nut 90 engages the bail 82 at the loop 88 thereby lifting the cylinder 58 and its associated first valve 64. When this occurs, the valve 64 is lifted above the valve seat 32 enabling the flow of water out of the tank 30 down to a level represented by a center line 42*b* (see FIGS. 4 and 6) which is equivalent to a full flush. It will be appreciated that by reason of the fact that the position of the nut 90 is adjustable on the lift wire 78, the exact point at which the lift wire engages the bail 82 can be adjusted and, thereby, the timing in the rotation of the handle 20 at which the first valve 64 becomes effective to enable a full flush of water from the tank 30.

In accordance with the invention, the apparatus is generally as previously described wherein said sleeve has an aperture extending therethrough and includes a pawl pivotally mounted to said sleeve; a float fixed on one end of said pawl responsive to the level of water within the tank to move said pawl between said first and second positions; a tooth on an opposite end of said pawl extending through the aperture and frictionally engageable with an outer surface of said cylinder when said pawl assumes the first position to thereby hold said first valve in its open position when a level of water within said tank is higher than a predetermined level. As embodied herein, the sleeve 52 is formed with an aperture 92. Viewing FIGS. 2 through 6, a pawl 94 is pivotally mounted on a pin 96 which extends between and is fixed at its opposite ends to opposed finger portions of a yoke 98 which is integral with the sleeve 52 and extends radially outwardly therefrom. A float 100 composed of low density rubber or other suitable floatable material is fixed on one end of the pawl 94 distant from the sleeve 52. A tooth 102 is integral with the opposite end of the pawl 94 and is positioned to extend through the aperture 92 and is frictionally engageable with an outer surface of the cylinder 58 when the pawl 94 assumes a first position (FIGS. 2, 3, and 5) to thereby hold the valve 64 in an open position when the level of water within the tank is higher than a predetermined level, that is, when it is sufficiently high to assure that the float 100 is buoyant such that it assumes the positions illustrated in FIGS. 2, 3, and 5.

In accordance with the invention, the apparatus is generally as previously described wherein said sleeve has an aperture extending therethrough and wherein said cylinder has an annular groove formed in its outer surface, including a pawl pivotally mounted to said sleeve; a float fixed on one end of said pawl responsive to the level of water within said tank to move said pawl between first and second positions; a tooth on an opposite end of said pawl extending through the aperture when said pawl assumes the first position, a plane containing an annular groove being positioned lower than a plane containing the aperture when said first valve is in its closed position and being positioned higher than a plane containing the aperture when said first valve is in its open position; said tooth being engageable with the groove when a level of water within said tank is higher than a predetermined level to thereby hold said first valve in its open position. As embodied herein, with particular reference to FIG. 9, the cylinder 58 is provided with an annular groove 104 formed in its outer surface. When the first valve 64 is in its closed position, a plane containing the annular groove 104 lies lower, that is, closer to the bottom 44 of the tank 30, than a plane containing the aperture 92. Conversely, when the first valve 64 is in its open position (FIGS. 4 and 6), the plane of the annular groove 104 lies at least as high as a plane containing the aperture 92. When the level of water within the tank 30 is sufficient to impart buoyancy to the float 100 and thereby maintain the tooth 102 of the pawl 94 in engagement with the outer surface of the cylinder 58, the tooth 102 is engageable with the groove 104 to thereby hold the valve 64 in its open position until such time that the water within the tank 30 drops to the level indicated by the center line 42*b*. When that occurs, the pawl 94 rotates in the direction of an arrow 105 (FIG. 4) to the position illustrated in FIG. 6 such that the tooth 102 no longer engages the outer surface of the cylinder 58 or the groove 104 and is therefore no longer effective to hold the valve 64 in its open position.

In accordance with the invention, the apparatus is generally as previously described and further including fasteners releasably mounting said sleeve to said standpipe for selectively adjusting the height of said sleeve in relation to the bottom of said tank. Viewing any of FIGS. 2 through 6, the fasteners 56 may be of the set screw variety which permit the bracket 54 to be adjustably positioned on the standpipe 38 to achieve a desired height of the sleeve 52 above the bottom 44 of the tank 30. In this manner, a coarse adjustment can be achieved for determining the final level of water in the tank 30 at which a full flush is achieved.

Figure 10:
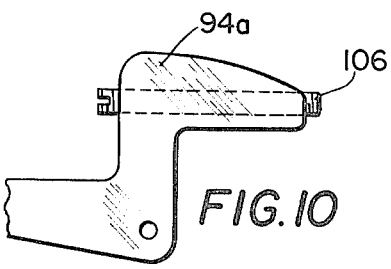
FIG. 10 is a detail side elevation view of parts illustrated in FIG. 9.

In accordance with the invention, the apparatus is generally as previously described wherein said tooth includes a screw member threadedly received within said pawl and movable between extended and retracted positions to thereby adjust the predetermined level of water at which said pawl is released from engagement with said cylinder. As embodied herein, and with particular reference to FIGS. 9 and 10, a screw member 106 may be threadedly received within a modified pawl 94*a* having sufficient thickness to enable a tapped hole to be formed within its structure. Thus, with the screw member 106 advanced from an extremity of the pawl 94, the pawl remains effective to hold the valve 64 in its raised position at even a lower water level than when the screw member is retracted. By this construction then, it can be said that a fine adjustment can be achieved for determining the final level of water in the tank 30 at which a full flush is achieved. In short, then while the fasteners 56 enable a coarse adjustment for determining the height of water in the tank 30 at which the valve 64 is reseated on the valve seat 32, the screw member 106 serves the same purpose, however, only as a fine adjustment.

The operation of the invention will now be described. In its quiet state, the tank 30 is filled with water essentially to the level of the center line 42 illustrated in FIG. 2. When it comes time to flush liquid waste from the toilet, the handle 20 can be rotated in the direction of the arrow 69 (FIG. 3) thereby causing the valve 66 to be lifted from the valve seat 68 permitting the discharge of water from the tank through the cylinder 58 and out the outlet defined by the fitting 48. The buoyancy in the valve 66 will assure that the valve will not fall back onto the valve seat 68 until the water level in the tank has descended substantially to the level indicated by the center line *42a* (FIG. 3).

When it is desired to discharge solid waste from the toilet, the handle 20 is rotated in the direction of the arrow 69 to the position illustrated in FIG. 4. When this occurs, the nut 90 on the lift wire 78 engages the bail 82 and thereby raises the valve 64 above its associated valve seat 32. In this manner, the water in the tank 30 flows out the support member 34 until such time that the water substantially assumes the level defined by the center line *42b* (FIG. 4). The tooth 102 on the pawl 94 engages the outer surface of the cylinder 58 to assure that the cylinder and its associated valve 64 will remain in its raised position (FIGS. 4 and 6) until the water is essentially fully discharged from the tank 30. At this time, the pawl 94 rotates in the direction of the arrow 105 (FIG. 4) and allows the valve 64 to reseat on the valve seat 32.

As previously described, the fasteners 56 can adjust the level of the water in the tank 30 at which the pawl 94 can withdraw from engagement with the outer surface of the cylinder 58 thereby permitting the valve 64 to reengage with the valve seat 32. This is considered to be a coarse adjustment of the water level defining a full flush and, similarly, a fine adjustment can be provided by means of the screw member 106. Also, as previously described, lateral positioning of the valve 64 relative to the seat 32 can be achieved by means of the fasteners 57 and associated slots *57a*.

Also, of course, the annular groove 104 (FIG. 9) does not alter the basic operation of the invention, but only assures a more positive engagement between the tooth 102 and the outer surface of the cylinder 58.

It will be appreciated that the invention may be provided as an entire pre-assembled unit in the form illustrated in FIG. 2. In this form, modification of the prior art construction of FIG. 1 is a simple task. Specifically, it is only necessary to remove valve 24 and lift wires 26 and 28 from lever 22 and remove bracket 40 from the existing standpipe 38. Thereupon the pre-assembled unit is easily installed by sliding brackets 54 and 40 over the existing standpipe 38, tightening and adjusting bracket 40 and set screws 56 in bracket 54. The mounting block 72 is then installed on existing lever 22, so as to receive the upper end of the lift wire 70 thereby completing the modification.

Thus, by the mere use of a screwdriver, a person with a minimum of mechanical skill can modify a conventional water closet to incorporate the structure and features of the present invention.

The invention in its broader aspects is not limited to the specific details shown and described; departures may be made from such details without departing from the principles of the invention and without sacrificing its chief advantages.

What is claimed is:

1. In combination with a toilet including a tank capable of being filled with water and having an outlet for draining water therefrom, a hollow support member mounted on the tank including a first valve seat communicating with the outlet, and a hollow standpipe mounted on said support member and extending upwardly therefrom, the interior of said standpipe being in communication through said support member with the outlet, the improvement comprising:

a tubular sleeve mounted to the standpipe and spaced therefrom;

a cylinder having upper and lower ends and slideably received within said sleeve and including a first valve fixed to its lower end movable between a closed position engageable with the first valve seat to prevent the flow of water out of the tank through the outlet and an open position spaced from the first valve seat to permit the flow of water out of the tank through the outlet, said upper end defining a second valve seat;

a second valve movable between a closed position engageable with said second valve seat to prevent the flow of water out of the tank through said cylinder and an open position spaced from said second valve seat to permit the flow of water out of the tank through said cylinder and then through the outlet;

a handle pivotally mounted on said tank;

a lever arm fixed at one end to said handle;

a first lift wire pivotally mounted at one end to said lever arm at a location distant from said handle;

a second lift wire fixed at one end to said second valve, said first and second lift wires being connected together and adapted for universal movement at locations intermediate said lever arm and said second valve, said first and second lift wires being relatively movable longitudinally;

a guide bracket fixed to the standpipe and effective to guide said second lift wire as it moves said second valve means between said open and closed positions;

a bail member fixed to said cylinder and slideably received on said second lift wire whereby rotation of said handle through the first range of travel causes said second lift wire to lift said second valve for disengagement from said second valve seat; and adjustable stop means including a nut threadedly received on said second lift wire engageable with said bail whereby continued rotation of said handle through the second range of travel causes said bail to engage said nut and lift said first valve to enable the flow of water out of the tank through the outlet.

2. The combination as set forth in claim 1, including fasteners releasably mounting said sleeve to said standpipe for selectively adjusting the height of said sleeve in relation to the bottom of said tank and wherein said sleeve has an aperture extending therethrough and including a pawl pivotally mounted to said sleeve; a float fixed on one end of said pawl responsive to the level of water within the tank to move said pawl between first and second positions; a tooth on an opposite end of said pawl extending through the aperture and frictionally engageable with an outer surface of said cylinder when said pawl assumes the first position to thereby hold said first valve in its open position when the level of water within the tank is higher than a predetermined level.

3. The combination as set forth in claim 1, including fasteners releasably mounting said sleeve to said standpipe for selectively adjusting the height of said sleeve in relation to the bottom of said tank and wherein said sleeve has an aperture extending therethrough and wherein said cylinder has an annular groove formed in its outer surface, and including a pawl pivotally mounted to said sleeve; a float fixed on one end of said pawl responsive to the level of water within the tank to move said pawl between first and second positions; a tooth on an opposite end of said pawl extending through the aperture when said pawl assumes the first position; a plane containing the annular groove being positioned lower than a plane containing the aperture when said first valve is in its closed position and being positioned higher than a plane containing the aperture when said first valve is in its open position; said tooth being engageable with the groove when the level of water within the tank is higher than a predetermined level to thereby hold said first valve in its open position.

4. Apparatus for flushing a toilet comprising:

a tank capable of being filled with water including a bottom and sidewalls, and having an outlet at its bottom for draining water therefrom;

a hollow support member mounted on said tank including a first valve seat adjacent the bottom of said tank and communicating with the outlet;

a hollow standpipe mounted on said support member and extending upwardly therefrom, the interior of said standpipe being in communication through said support member with the outlet;

a tubular sleeve mounted to said standpipe and spaced therefrom;

a cylinder having upper and lower ends slideably received within said sleeve and including a first valve fixed to its lower end movable between a closed position engageable with said first valve seat to prevent the flow of water out of said tank through the outlet and an open position spaced from said first valve seat to permit the flow of water out of said tank through the outlet, said upper end defining a second valve seat;

a second valve movable between a closed position engageable with said second valve seat to prevent the flow of water out of said tank through said cylinder and an open position spaced from said second valve seat to permit the flow of water out of said tank through said cylinder and then through the outlet;

a handle pivotally mounted on a sidewall of said tank;

a lever arm fixed at one end to said handle;

a first lift wire pivotally mounted at one end to said lever arm at a location distant from said handle;

a second lift wire fixed at one end to said second valve, said first and second lift wires being connected together and adapted for universal movement at locations intermediate said lever arm and said second valve, said first and second lift wires being relatively movable longitudinally;

a guide bracket fixed to said standpipe and effective to guide said second lift wire as it moves said second valve means between said open and closed positions;

a bail member fixed to said cylinder and slideably received on said second lift wire whereby rotation of said handle through a first range of travel causes said second lift wire to lift said second valve to be disengaged from said second valve seat and resulting in a flow of water from said tank equivalent to a partial flush; and adjustable stop means including a nut threadedly received on said second lift wire engageable with said bail member whereby continued rotation of said handle through a second successive range of travel causes said bail member to engage said nut and lift said first valve to enable the flow of water out of said tank through the outlet and resulting in a flow of water from said tank equivalent to a full flush.

5. Apparatus as set forth in claim 4, including fasteners releasably mounting said sleeve to said standpipe for selectively adjusting the height of said sleeve in relation to the bottom of said tank and wherein said sleeve has an aperture extending therethrough and including a pawl pivotally mounted to said sleeve; a float fixed on one end of said pawl responsive to the level of water within said tank to move said pawl between first and second positions; a tooth on an opposite end of said pawl extending through the aperture and frictionally engageable with an outer surface of said cylinder when said pawl assumes the first position to thereby hold said first valve in its open position when the level of water within said tank is higher than a predetermined level.

6. Apparatus as set forth in claim 5 wherein said tooth includes a screw member threadedly received within said pawl and movable between extended and retracted positions to thereby adjust the predetermined level of water at which said pawl is released from engagement with said cylinder.

7. Apparatus as set forth in claim 4, including fasteners releasably mounting said sleeve to said standpipe for selectively adjusting the height of said sleeve in relation to the bottom of said tank and wherein said sleeve has an aperture extending therethrough and wherein said cylinder has an annular groove formed in its outer surface, and including a pawl pivotally mounted to said sleeve; a float fixed on one end of said pawl responsive to the level of water within said tank to move said pawl between first and second positions; a tooth on an opposite end of said pawl extending through the aperture when said pawl assumes the first position, a plane containing the annular groove being positioned lower than a plane containing the aperture when said first valve is in its closed position and being positioned higher than a plane containing the aperture when said first valve is in its open position; said tooth being engageable with the groove when the level of water within said tank is higher than a predetermined level to thereby hold said first valve in its open position.

8. Apparatus as set forth in claim 7 wherein said tooth includes a screw member threadedly received within said pawl and movable between extended and retracted positions to thereby adjust the predetermined level of water at which said pawl is released from engagement with said cylinder.

* * * * *